US005924232A

United States Patent [19]

Rhoden et al.

[11] Patent Number: 5,924,232

[45] Date of Patent: Jul. 20, 1999

[54] INTELLIGENT FIREARM SAFETY MECHANISM

[75] Inventors: David Rhoden; Richard Sawaya, both of Southfield, Mich.

[73] Assignee: Programmable Safety Systems Corporation, Southfield, Mich.

[21] Appl. No.: 08/893,895

[22] Filed: Jul. 11, 1997

[51] Int. Cl.[6] ..... F41A 17/00

[52] U.S. Cl. ..... 42/70.11

[58] Field of Search ..... 42/70.11

[56] References Cited

U.S. PATENT DOCUMENTS

| | | | |
|---|---|---|---|
| 4,009,536 | 3/1977 | Wolff | 42/84 |
| 4,270,295 | 6/1981 | Grehl | 42/70 |
| 4,575,963 | 3/1986 | Ruger et al. | 42/70 |
| 5,016,376 | 5/1991 | Pugh | 42/70.11 |
| 5,022,175 | 6/1991 | Oncke et al. | 42/70.11 |
| 5,062,232 | 11/1991 | Eppler | 42/70.11 |
| 5,419,069 | 5/1995 | Mumbleau et al. | 42/70.11 |
| 5,448,847 | 9/1995 | Teetzel | 42/70.11 |
| 5,459,957 | 10/1995 | Winer | 42/70.11 |
| 5,546,690 | 8/1996 | Ciluffo | 42/70.11 |
| 5,570,528 | 11/1996 | Teetzel | 42/70.11 |

*Primary Examiner*—Charles T. Jordan
*Assistant Examiner*—Meena Chelliah
*Attorney, Agent, or Firm*—Gifford, Krass, Groh, Sprinkle, Patmore, Anderson & Citkowski

[57] ABSTRACT

An electronically activated safety mechanism for a firearm which introduces a simple obstruction to the firing-pin itself, thereby offering a high degree of simplicity and reliability. In a preferred embodiment, a solid cylindrical block is provided and is movable along a first axis between a first, safety position and a second, firing position through the action of a first solenoid. The firing-pin block includes a bore formed centrally therethrough which is in alignment with the firing-pin when the cylindrical block is in a second, firing position. Electronics entirely self-contained within the weapon may be used for both arming and disarming, with such capabilities taking the form of a voice-response unit, keypad with security code or other operator-specific configurations. In an alternative embodiment of this aspect of the invention, an off-weapon signaling unit is provided, for example, in the form of a watch, bracelet, or other item worn by an authorized user.

19 Claims, 3 Drawing Sheets

(Safety ON)

(Firing Position)

INTELLIGENT FIREARM SAFETY MECHANISM

FIELD OF THE INVENTION

The present invention relates generally to safety mechanisms for firearms such as pistols, and the like, and, in particular, to an electronically activated safety mechanism that directly enables and disables a firing-pin.

BACKGROUND OF THE INVENTION

Although weapons such as firearms can provide a great deal of protection in a hostile situation, a loaded gun is a dangerous instrumentality which may be used against a law-enforcement officer by a criminal perpetrator. Accordingly, numerous inventions have been devised and protected relating to firearm safety, with one goal being the prevention of misuse. In particular, a variety of mechanisms exist which prevent the firearm from discharging either accidently, such as upon impact with a hard surface, or intentionally by an unauthorized user, such as a child or criminal. Such safety mechanisms are variously configured, and include mechanical and magnetically operated key-type mechanisms as well as mechanisms electronically operated.

Such safety mechanisms typically prevent the firing of a weapon by either disabling a linkage that acts upon the firing-pin, or by disabling the firing-pin directly. For example, U.S. Pat. No. 5,016,376 to Pugh discloses a magnetically actuated firearm locking mechanism wherein a solenoid, actuated or deactuated upon receiving an electrical signal, moves a locking rod into a position which prevents the firing of the weapon by blocking the movement of the hammer or trigger. The solenoid is in electrical communication with a decoder. A user must possess an encoder which creates a signal received by the decoder indicating that the user is authorized to use the weapon. The decoder then actuates the solenoid to move the locking rod linkage into a position whereby the firearm may be operated.

Other safety mechanisms for firearms operate by directly blocking movement of the firing-pin. U.S. Pat. No. 4,090,316 to Volkmar discloses a firearm which has a firing-pin pivotable between safety and firing positions by a release lever. The hammer of such firearm has a striking surface which engages the firing-pin only when the firing-pin is in its firing position. When the firing-pin is in a safety position, the striking surface of the hammer does not engage the firing-pin, thus preventing discharge of the firearm.

Likewise, U.S. Pat. No. 4,658,529 to Bertolini discloses a firearm safety mechanism which acts directly on the firing-pin. The firing-pin is provided with an annular groove which interacts with a rib disposed on a safety latch, the safety latch being moveable between an "on" and "off" position. As the safety is moved into the "on" position, the rib enters the annular groove on the firing-pin, camming the firing-pin so as to retract and lock the pin into a fixed position. When the safety is moved to the "off" position, the rib disengages the firing-pin, positioning the firing-pin so that the hammer end of the firing-pin may be impacted by the hammer.

Although the prior art discloses electronically activated safety mechanisms in general, and mechanical latch mechanisms in particular, all existing devices either operate on mechanisms removed from the firing-pin, and are therefore more prone to malfunction, or, if they act directly on the firing-pin, are too complex or unreliable, thereby requiring frequent maintenance.

SUMMARY OF THE INVENTION

The present invention improves upon the existing art by providing an electronically activated safety mechanism for a firearm which introduces a simple obstruction to the firing-pin itself, thereby offering a high degree of simplicity and reliability. In a preferred embodiment, a solid cylindrical block is provided and is movable between a first, safety position and a second, firing position through the action of electromotive drive means in the form of a first solenoid, which may be electronically driven. A first spring engages the cylindrical block to bias the block in its first, safety position.

The cylindrical block includes a bore formed centrally therethrough which is in alignment with the firing-pin when the cylindrical block is in its second, firing position. The bore extends normally to the first axis, allowing the firing-pin to penetrate therethrough when the bore and firing-pin are aligned. Preferably, the firing-pin and, therefore, the bore through the cylindrical block, are cylindrical in shape.

A groove positioned on the exterior of the cylindrical block is provided adjacent to the bore. When the cylindrical block is positioned in its first, safety position, the firing-pin is aligned with a distal wall of the groove rather than the bore. If the firing-pin is inadvertently released while the cylindrical block is in its first, safety position, the firing-pin will strike the cylindrical block rather than pass through the bore, thereby preventing the firing-pin from impacting a bullet positioned on the other side of the block thus preventing discharge of the firearm. As the first solenoid is actuated to move the cylindrical block to its second, firing position by compressing the first spring, the firing-pin is aligned with the bore, permitting the firing-pin to pass through the bore and cylindrical block and impact a bullet position on the other side of the cylindrical block and discharging the firearm.

To minimize electrical current drain within the weapon, the first solenoid is preferably activated momentarily to move the cylindrical block against the first biasing spring, at which point a mechanical latch, also spring biased, engages a notch feature on the cylindrical block, thereby holding the cylindrical block in its second, firing position. To release this latch, another electromotive drive, preferably in the form of a second, smaller solenoid, is used to lift this latch, which is biased downwardly by a second spring, to release the cylinder, returning it to the first, safety position. As with the first solenoid, the various spring biasing features require that the latch release mechanism be activated for a short period of time, after which the system once again automatically returns to an electrically quiescent condition.

Given that both arming and disarming of a weapon according to the invention is made possible by electromotive means, these mechanical drivers may, and are preferably, activated electronically. According to this aspect of the invention, electronics entirely self-contained within the weapon may be used for both arming and disarming, with such capabilities taking the form of a voice-response unit, keypad with security code and/or other operator-specific configurations. In an alternative embodiment of this aspect of the invention, an off-weapon signaling unit is provided, for example, in the form of a watch, bracelet, button cover, or other item worn by an authorized user, which communicates with the weapon, causing it to enter a firing mode upon entry of a voice command or keyboard entry, similar to the weapon-integrated configurations discussed above. As an alternative, however, with an off-weapon activation and deactivation capability, the weapon may automatically enter an disarmed state if a suspicious or dangerous condition is met, such as too great a physical distance between the firearm and the signaling unit worn by the authorized user.

The invention is applicable to both hand guns and rifles, including revolvers and non-sliding block type rifles. With modification, the invention is applicable to blow-back operated semi-automatic pistols, and can be configured to operate in a vertical position with the mechanisms being appropriately configured as to not to interfere with the path of the slide, or such as moving axially along the length of the firing-pin with the slide.

BRIEF DESCRIPTION OF THE DRAWINGS

Other objects, advantages and applications of the present invention will be made clear by the following detailed description of a preferred embodiment of the invention. The description makes reference to drawings in which.

DETAILED DESCRIPTION OF THE INVENTION

Figure 1:
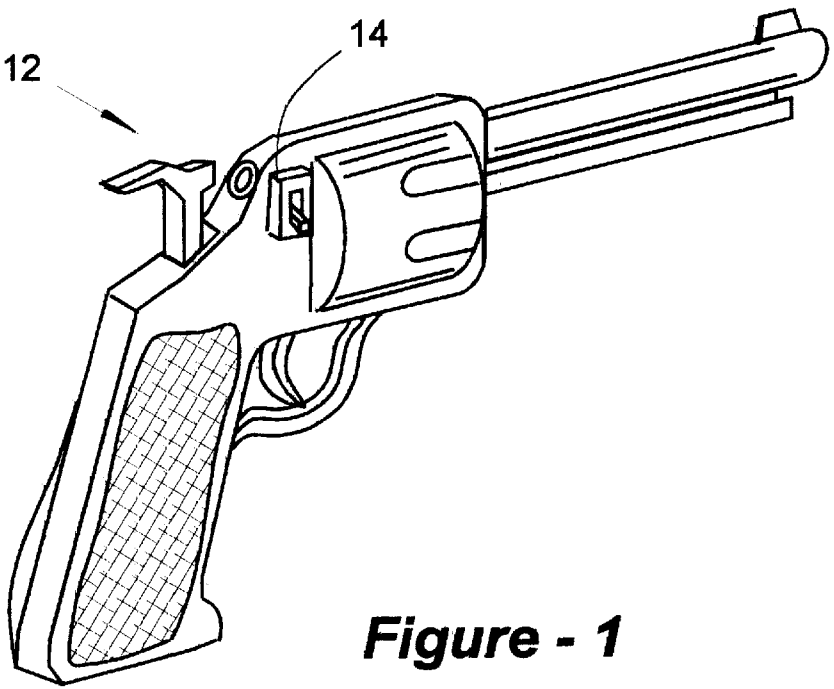
FIG. 1 is a perspective view of a preferred embodiment of the invention.

The present invention is a system for preventing the accidental or unwanted discharge of a firearm. FIG. 1 is an oblique representation of a weapon incorporating the invention, in this case, a hand gun. The invention is incorporated in the vicinity of area 12, but the only aspect visible from this view, is a manually operated safety lock 14, additional information about which is provided below.

Figure 2C:
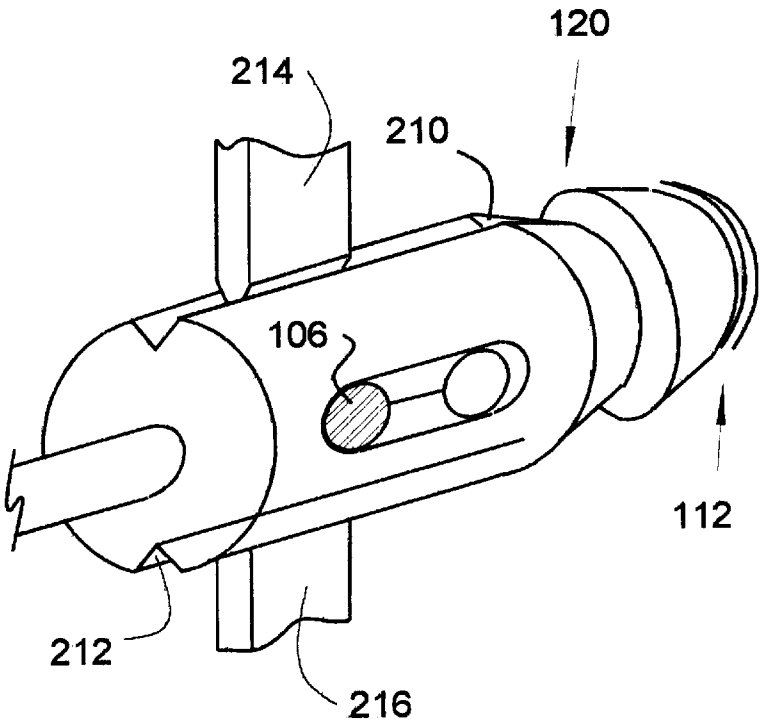
FIG. 2C is an oblique, close-up view of the firing-pin block and grooves formed therein.
Figure 2A:
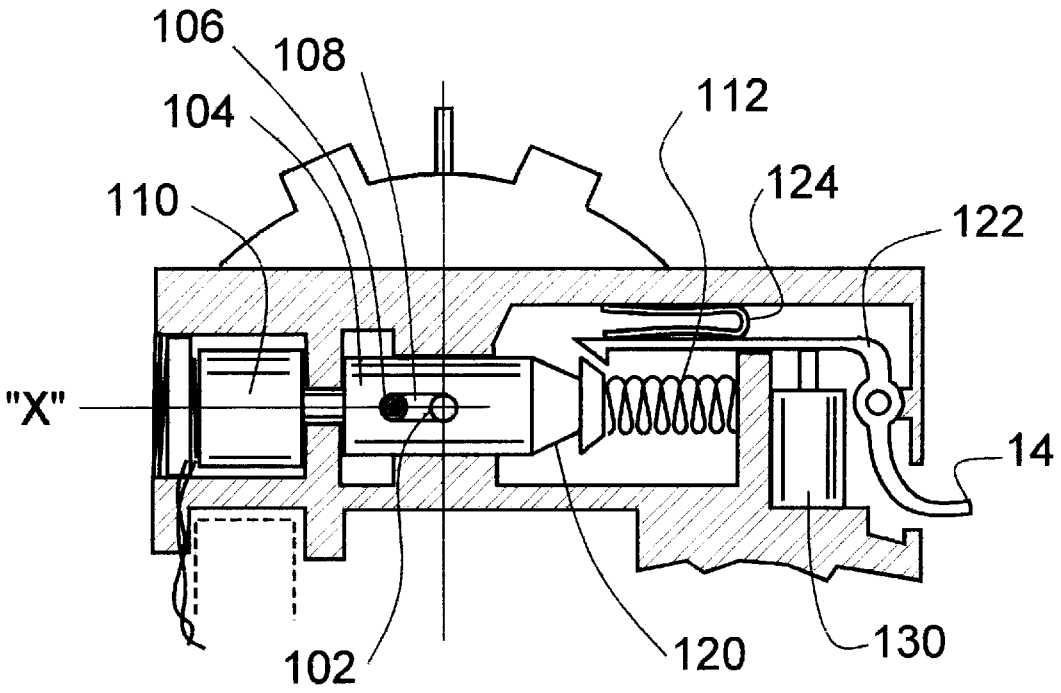
FIG. 2A is a view in partial cross-section illustrating a configuration wherein a firing-pin is blocked according to the invention to prevent discharge of a weapon.
Figure 2B:
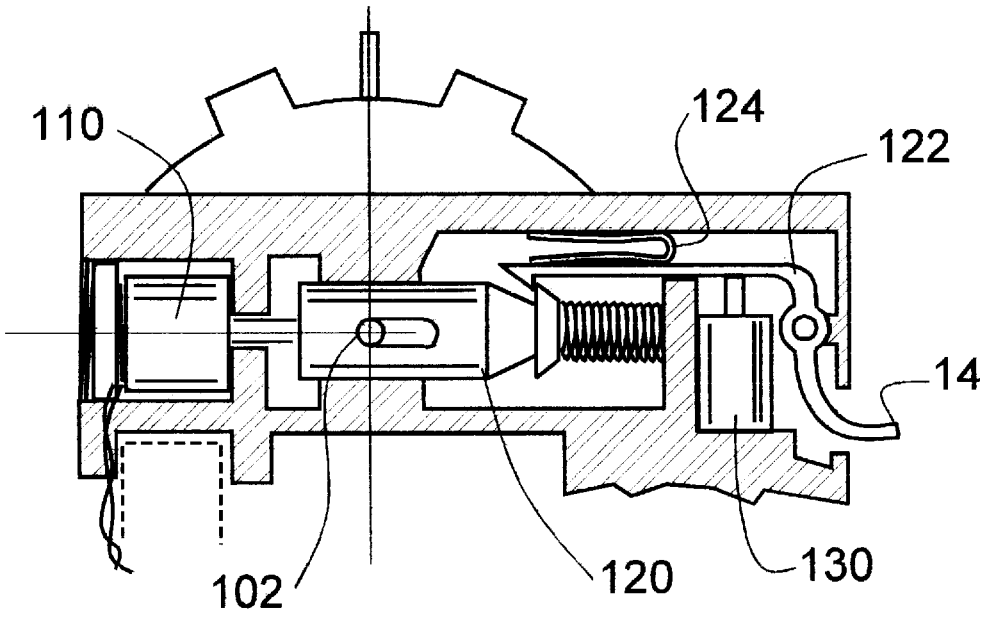
FIG. 2B is a view of the configuration of FIG. 2A, but with the firing-pin no longer blocked, thereby facilitating discharge of the weapon.

FIGS. 2A and 2B show a firing-pin block 104 movable along a first axis "X" between a first, safety position (depicted in FIG. 2A), and a second, firing position (depicted in FIG. 2B). Firing-pin 102 moves along an axis "Y", which is normal to the axis. As such, the firing-pin 102 preferably moves transversely with respect to cylindrical block 104. A first spring 112 engages one end of cylindrical block 104 and biases cylindrical block 104 into its normal safety position. A first solenoid 110, positioned at the other end of cylindrical block 104, upon activation, moves the cylindrical block 104 against first spring 112, thus moving cylindrical block 104 into its second, firing position as shown in FIG. 2B.

A groove 108, best seen in FIG. 2C, is formed on the exterior surface of cylindrical block 104, with the forward end of firing-pin 102 being positioned proximate to groove 108. A bore 106, extending through cylindrical block 104, is positioned adjacent to groove 108. Firing-pin 102 is positioned with respect to bore 106 so that, when bore 106 is in its first, safety position, firing-pin 102 is not aligned with bore 106. Thus, if the firing-pin is inadvertently released, the firing-pin will strike the wall of groove 108 rather than pass through bore 106.

As first solenoid 110 is activated, cylindrical block 104 is moved into its second, firing position, bringing bore 106 into alignment with firing-pin 102. Thus, when cylindrical block 104 is in its second, firing position, firing-pin 102 is aligned with bore 106 so that firing-pin 102 may pass through bore 106, as shown in FIG. 2B, to impact a bullet 126 positioned (but not visible) on the opposite side of cylindrical block 104.

A latching mechanism is so that, as first solenoid 110 moves cylindrical block 104 into its second, firing position, the cylindrical block 104 is held in the second, firing position so that first solenoid 110 may be deactivated. In the preferred embodiment, a latch 122 is provided and activated by a second solenoid 130 or the manual lever 14. A second spring 124 is positioned so as to bias latch 122 downwardly. As second solenoid 130 is activated, latch 122 is moved upwardly, compressing second spring 124.

An annular groove 120 is formed in cylindrical block 104 proximate to the latching mechanism. When cylindrical block 104 is moved to its second, firing position by the activation of first solenoid 110, latch 122 raises so that the forward end of latch 122 engages with the groove 120. Once latch 122 has engaged groove 120, the second spring 124 continues to bias latch 122 downwardly so that it remains in engagement, thereby retaining cylindrical block 104 in its second, firing position. To release the latch 122 and return the weapon to the safety position of FIG. 2A, either the manually operated lever 14 may be utilized or, a signal may be sent to second solenoid 130 to raise the latch momentarily against biasing spring 124, with the first spring 112 then being able to move the cylinder 104 back into the position shown in FIG. 2A, thereby once again blocking the firing-pin 102 from entering into the bore 106.

To ensure that the block 104 is not prone to rotational movement, one or more grooves are formed along its side wall, these being parallel to the axis "X," and members are provided which cooperate with these grooves, as seen in FIG. 2C. Two grooves are shown in this figure, 210 and 212 which engage with members 214 and 216, respectively. Clearly more or fewer arrangements of this kind may be accommodated according to the invention, as can be a firing-pin block which is non-cylindrical in shape, so long as the teachings contained herein are practiced.

Figure 3:
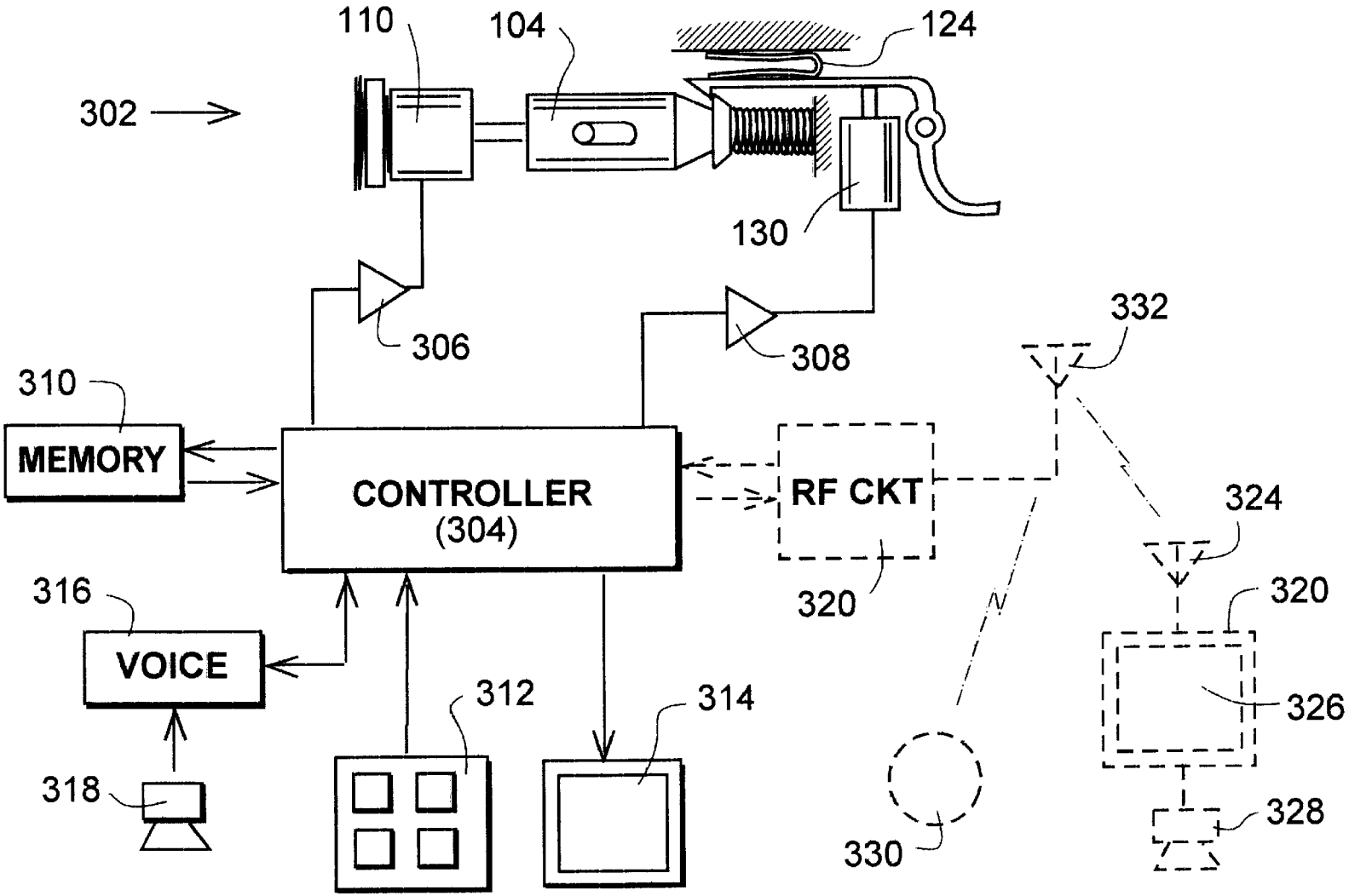
FIG. 3 is a diagrammatic view of the electronics of the present invention.

To move cylindrical block 104 between the firing and safety positions, a controller may be utilized to coordinate the activation and deactivation of the solenoids, as shown in FIG. 3. Solenoids 110 and 130 and associated mechanisms such as firing-pin block 104 are shown in the upper portion in this drawing in the general vicinity of 302, with remaining electronic devices being depicted therebelow. Broadly, a controller 304 outputs signals to driving circuits 306 and 308, which are coupled to the first and second solenoids, respectively. The controller 304 may be custom or, more preferably, of conventional design in the form of a microprocessor or single-chip microcomputer of the type available from various manufacturers such as Intel Corp., Motorola, and others. Depending upon the type of the device 304, more or fewer of the components described herein may be included "on board," is known to those of ordinary skill in micro system design. For example, in memory 310, which may be of the volatile or non-volatile types, may be included as a peripheral in the event that controller 304 is insufficient in this regard. For the storage of control codes, as discussed below, preferably a non-volatile memory such as an electrically erasable programmable read-only memory is utilized, enabling non-volatile storage without the necessity of battery back-up.

In an embodiment wherein switches or controls are provided on the firearm itself to activate and deactivate the firing-pin block, a keyboard 312 may be utilized for this purpose, and an optional display 314 may be provided as a status indicator. In the event of a voice-recognition type activation of the unit, specialized voice circuitry 316 may be provided in the event that controller 304 is incapable of performing such tasks, with the microphone 318 being used as a pickup, both for training and arm/disarm vocal commands. Although comprehensive speaker-independent recognition of connected speech remains a difficult problem, in the present invention, since a small vocabulary is used, preferably in conjunction with a speaker-dependent activation and deactivation, the problems associated with comprehensive voice recognition may be greatly simplified herein.

All of the components just described would typically be provided on the weapon itself. For example, the keyboard may be on the handle of the firearm, along with the display, and the microphone 318 may be provided in any convenient place so long as it efficiently performs its intended function. As discussed above, off-weapon arming and/or facilities are accommodated by the invention as well. For example, an RF receiver circuit 320 may be added in communication with controller 304, including an antenna 322 in communication with one of a variety of wireless sending units. For example, a keypad 320 and associated circuitry having an antenna 324 may be utilized to program and communicate authorization codes to the weapon, serving as a base unit. The unit 320 may be physically configured in any size so long as it is accessible, including as a hand-held pocket-size keychain type unit, wristwatch, and so forth. In addition to the keypad 326, a microphone 328 may be added, enabling voice activation and/or deactivation to occur from a remote unit (such as a wristwatch), as well as remote programming. As an alternative to a device with a keypad or voice input, a much smaller unit shown in broken-line form 330 may be used, such as a ring or button worn on the person of the authorized user. In such a case, the item may be too small to include manually or voice-operated functions, such that mere distance away from the weapon will automatically deactivate it. In the case of a ring worn on the hand of the user holding the gun, this distance may be very small, on the order of a couple inches or less, whereas, if the unit 330 is a button, the distance may be on the order of one or more feet. To reduce the amount of circuitry in the unit 330, as an alternative to a wireless broadcast, the weapon itself may be equipped with some sort of detector or sender/receiver, enabling the unit 330 to be substantially passive. For example, the weapon may include a metal detector specifically engineered to detect proximity of the unit 330, or the unit 330 may be include a device such as an acoustic resonator which may then be detected by the weapon. As a further alternative, the device 330 may incorporate a flat coil of the type used to ensure that books are not carried from libraries and other places.

I claim:

1. A safety system for use with a firearm of the type having a firing-pin movable along a firing-pin path co-axial to the barrel of the firearm, the system comprising a firing-pin blocking unit positioned in the firearm, the blocking unit being moveable between a first position wherein the firing-pin is operative to discharge the firearm, and second position wherein the blocking unit is moved into the firing-pin path;

an electromotive mechanism coupled to the firing pin blocking unit, the mechanism being operative to move the firing pin blocking unit between the first and second positions in response to a control signal;

a releasable latch operative to hold the firing-pin blocking unit in the first position to discharge the firearm; and electronic circuitry outputting the control signal to the electromotive source in response to a command from an authorized user of the firearm.

2. The firearm safety of claim 1, wherein the electromotive mechanism operates momentarily in response to the control signal, after which the firing-pin blocking unit remains physically in place to minimize electrical power consumption within the firearm.

3. The firearm safety of claim 2, further including an electromotive drive used to release the latch, causing the firing-pin blocking unit to move to the first position.

4. The firearm safety of claim 1, wherein the electronic circuitry includes a keypad, mounted on the firearm, through which an authorized user may enter a security code to arm and disarm the firearm.

5. The firearm safety of claim 1, wherein the electronic circuitry includes a microphone and voice-recognition circuitry through which an authorized user may annunciate a security code to arm and disarm the firearm.

6. The firearm safety of claim 1, wherein the electronic circuitry includes a remote unit in communication with the firearm which an authorized user may enter a security code to disarm the firearm.

7. The firearm safety of claim 6, wherein the remote unit transmits a wireless signal to the firearm to at least disarm the firearm.

8. The firearm safety of claim 6, wherein the firearm senses the proximity of the remote unit to at least disarm the firearm.

9. A safety system for use with a firearm of the type having a firing-pin, the system comprising a firing-pin blocking unit positioned in the firearm, the blocking unit being moveable between a first position wherein the firing-pin is operative to discharge the firearm, and second position wherein the firing-pin is physically incapable of discharging the firearm;

a first electromotive drive unit operative to move the firing-pin blocking unit from the second position into the first position;

a second electromotive drive unit operative to move the firing-pin blocking unit from the second position into the first position; and electronic circuitry outputting the control signal to the first and second electromotive drive units in response to a command from an authorized user of the firearm.

10. The firearm safety of claim 9, wherein the first and second electromotive drive units are solenoids.

11. The firearm safety of claim 9, further including a first spring associated with the first electromotive drive unit and a second spring associated with the first electromotive drive unit, enabling the firing-pin blocking unit to move between the first and second positions through a momentary activation, thereby conserving electrical power in between movements of the blocking unit.

12. The firearm safety of claim 9, wherein the firing-pin blocking unit takes the form of a solid cylindrical mass movable along a first axis between a first, safety position and a second, firing position through the action of the drive means.

13. The firearm safety system of claim 12, wherein the cylindrical block includes a bore formed centrally therethrough which is in alignment with the firing-pin when the cylindrical block is in its second, firing position.

14. The firearm safety system of claim 13, further including a groove formed on the exterior of the cylindrical block such that, with the cylindrical block in the first position, the firing-pin is aligned with a distal wall of the groove rather than the bore.

15. The firearm safety of claim 9, wherein the electronic circuitry includes a keypad, mounted on the firearm, through which an authorized user may enter a security code to arm and disarm the firearm.

16. The firearm safety of claim 9, wherein the electronic circuitry includes a microphone and voice-recognition circuitry through which an authorized user may annunciate a security code to arm and disarm the firearm.

17. The firearm safety of claim 9, wherein the electronic circuitry includes a remote unit in communication with the firearm which an authorized user may enter a security code to arm and disarm the firearm.

18. The firearm safety of claim 17, wherein the remote unit transmits a wireless signal to the firearm to at least disarm the firearm.

19. The firearm safety of claim 17, wherein the firearm senses the proximity of the remote unit to at least disarm the firearm.

* * * * *